US005666026A

United States Patent [19]

Matsuno et al.

[11] Patent Number: 5,666,026

[45] Date of Patent: Sep. 9, 1997

[54] DIELECTRIC BARRIER DISCHARGE LAMP

[75] Inventors: Hiromitsu Matsuno; Nobuyuki Hishinuma; Kenichi Hirose; Kunio Kasagi; Fumitoshi Takemoto, all of Hyogo-ken; Yoshinori Aiura, Tokyo; Tatsushi Igarashi, Hyogo-ken, all of Japan

[73] Assignee: Ushiodenki Kabushiki Kaisha, Tokyo, Japan

[21] Appl. No.: 530,655

[22] Filed: Sep. 20, 1995

[30] Foreign Application Priority Data

Sep. 20, 1994 [JP] Japan ..... 6-250201

[51] Int. Cl.[6] ..... H01J 17/16; H01J 61/06

[52] U.S. Cl. ..... 313/634; 313/607; 313/631; 313/234

[58] Field of Search ..... 313/607, 618, 313/631, 634, 234, 238, 283, 292

[56] References Cited

U.S. PATENT DOCUMENTS

| | | | |
|---|---|---|---|
| 4,837,484 | 6/1989 | Eliasson et al. | 313/234 |
| 4,945,290 | 7/1990 | Eliasson et al. . | |

FOREIGN PATENT DOCUMENTS

| | | | |
|---|---|---|---|
| 0458140 | 11/1991 | European Pat. Off. | 313/234 |
| 1-144560 | 6/1989 | Japan . | |
| 6-338302 | 12/1994 | Japan | 313/234 |

OTHER PUBLICATIONS

Denki–Gakkai, "Discharge Handbook", vol. 7, Published in Jun. of 1989, Electric Association.

*Primary Examiner*—Nimeshkumar Patel

*Attorney, Agent, or Firm*—Sixbey, Friedman, Leedom & Ferguson P.C.; David S. Safran

[57] ABSTRACT

A dielectric barrier discharge lamp having a generally cylindrical double-tube arrangement of an outer tube coaxially disposed about an inner tube, with an outer electrode disposed on an outside surface of the outer tube, an inner electrode disposed on an inside surface of the inner tube, and a discharge space provided between the outer tube and the inner tube which is filled with a discharge gas for formation of excimer molecules by dielectric barrier discharge achieves firm engagement of the inner electrode against the inner tube and a stable discharge over a long time even if part of the electrode corrodes due to the ozone produced or it wears. This is achieved by embodiments in which the inner electrode is a generally tubular part which is slit in an axial direction along the full length thereof. The tubular part can be a single cylindrically sheet having opposite longitudinally extending edges spaced from each other by a gap or overlapped. Alternatively, the tubular part can be formed of a pair of substantially semi-cylindrical parts which are separated by a gap between each pair of longitudinally extending edges.

12 Claims, 3 Drawing Sheets

DIELECTRIC BARRIER DISCHARGE LAMP

BACKGROUND OF THE INVENTION

1. Field of the Invention

The invention relates to a so-called dielectric barrier discharge lamp in which excimer molecules are formed by a dielectric barrier discharge, and in which the light emitted from the excimer molecules is used, for example, as an ultraviolet light source for a photochemical reaction.

2. Description of the Related Art

From unpublished Japanese patent specification HEI 1-144560 or U.S. Pat. No. 4,837,484, a radiator, i.e., a dielectric barrier discharge lamp, is known as generic technology, in which a discharge vessel is filled with a gas which forms an excimer molecule, and in which light which is emitted by a dielectric barrier discharge from the excimer molecules is emitted from the lamp.

This dielectric barrier discharge is also called an ozone production discharge or a silent discharge, as is described in the "Discharge Handbook", Elektrogesellschaft, June 1989, 7th edition, page 263.

In the aforementioned publication, it is described that a transparent discharge vessel which has a roughly cylindrical shape works at least partially also as the dielectric of the dielectric barrier discharge, and in it the light is emitted from excimer molecules. Furthermore it is described that an outside tube and an inside tube are arranged coaxially to one another as a double tube, that the outside surface of the outside tube is provided with a network-like electrode, that the inside surface of the inside tube is provided with an inside electrode, and that in the discharge space, between this outside tube and this inside tube, the dielectric barrier discharge is accomplished.

A dielectric barrier discharge lamp of this type has advantages which neither a conventional mercury low pressure lamp nor a conventional high pressure arc discharge lamp have; for example, the emission of ultraviolet beams with short waves, in which the primary wavelengths are 172 nm, 222 nm, and 308 nm, and at the same time selective generation of light with individual wavelengths with high efficiency which are roughly like line spectra can be achieved.

Furthermore, this type of lamp has the advantage that commercial quartz glass can be used for the discharge vessel, a simple arrangement of the entire lamp can be obtained and production can be easily achieved if it has a roughly cylindrical outside shape and a coaxial arrangement of the outside tube and the inside tube, as is described above.

The conventional dielectric barrier discharge lamp however has the following disadvantages:

(1) First of all, the inside electrode cannot be easily manufactured.

In order to effectively supply power to the inside electrode to cause the dielectric barrier discharge, it is necessary to arrange the inside electrode head-to-head tightly against the inside tube. Conventionally, therefore, an electrode in the form of a thin film was formed in the inside tube by a vapor deposition process.

The inside tube, however, has, for example, a diameter from 10 to 20 mm and a length of roughly 100 mm to 1000 mm. This means that vapor deposition must be performed within this narrow space and formation of a vapor deposited film with a uniform thickness was not possible.

Furthermore, the film formed by vapor deposition detaches easily from the inside tube if its thickness is greater than or equal to 0.01 mm.

Moreover, the disadvantage arose that nondestructive study of the thickness of the inside electrode is not possible even if the inside electrode can be advantageously formed.

(2) Second, the inside electrode easily corrodes if the dielectric barrier discharge lamp is operated over a long time. Corrosion occurs especially easily in a part in which its thickness is low. If corrosion causes a decrease of conductivity, it no longer functions as an electrode, and the service life of the lamp is shortened. The mechanism for this corrosion of the inside electrode presumably functions as follows:

(a) For the discharge gas encapsulated in the discharge space, a mixed gas of chlorine with an inert gas, such as xenon or argon or the like, is used. The action of these gases causes emission of vacuum ultraviolet light which is absorbed by the oxygen, generating ozone therefrom.

(b) In the dielectric barrier discharge lamp of the double tube type which consists of an inside tube and an outside tube, for safety, the inside electrode located in the inside tube is located on the high voltage side and the network-like electrode located in the outside tube is located on the ground side. The reason for this is that there is only a small probability that the inside electrode will come into contact with individuals and the like.

Furthermore, there are cases in which, in the inside electrode to which high voltage is applied, a glow discharge occurs which also produces ozone from the oxygen.

As described above, it is possible for the inside electrode to be corroded by the ozone which is produced by the vacuum ultraviolet light and the glow discharge.

On the other hand, it is possible in a conventional discharge lamp to provide a large interval between the electrode and the line and the light emission part in which the ozone is generated. In the dielectric barrier discharge lamp, however, it is fundamentally impossible to effect a large interval between the electrode and the light emission part by the arrangement in which the electrode and the light emission part are arranged adjacent to one another.

This means that the above described disadvantage of corrosion by ozone is characteristic of a dielectric barrier discharge lamp.

It is certainly conceivable that instead of producing the above described inside electrode by the vapor deposition process, a metal tube is used as the inside electrode. This process can eliminate the disadvantage of the above described vapor deposition process. However, the disadvantage arises that the adhesive property between the inside electrode and the inside tube deteriorates seriously, and that the amount of power supplied to the discharge space has a dispersion since the inside diameter of the commercial quartz glass tube which is used as the inside tube has a large tolerance of ±0.5 mm.

SUMMARY OF THE INVENTION

A primary object of the present invention is, therefore, to devise a dielectric barrier discharge lamp in which (1) an inside electrode can be easily produced and can be arranged head-to-head tightly against the inside tube, and in which (2) stable discharge can be accomplished over a long time, even if part of the electrode corrodes, due to the ozone produced, or wears.

This object is achieved according to the invention by the fact that, in a dielectric barrier discharge lamp which has a roughly cylindrical double tube arrangement with a coaxial arrangement of an outside tube and an inside tube, in which on the outside surface of this outside tube there is an outside electrode, in which on the inside of the inside tube there is an inside electrode, and in which the discharge space between this outside tube and this inside tube is filled with a discharge gas for formation of excimer molecules by a dielectric barrier discharge, the inside electrode is formed of a roughly tubular part which has a gap over the entire length in its axial direction.

The object is furthermore achieved by the fact that the gap of the inside electrode is less than or equal to 3.0 mm in the peripheral direction.

The object is also achieved according to the invention by the fact that the inside electrode comprises a pair of semicircular parts between which there is an intermediate space.

Moreover, the object is achieved according to the invention by the inside electrode being formed of aluminum of a thickness ranging from 0.1 mm to 1.0 mm.

Furthermore, the object is achieved according to the invention by forming the inside electrode in such a way that a metal sheet is bent in the manner of a tube and at the same time it comes to rest at least partially on it.

Furthermore the object is achieved according to the invention by the thickness of the metal sheet which forms the inside electrode being in the range from 0.03 to 0.1 mm.

The inside electrode is produced in an extremely simple manner by the measure in which the inside electrode is not produced by the vapor deposition process, but in which a roughly tubular part is used for this purpose. Furthermore, because it has a gap in its axial direction over the entire length, the tubular electrode part can be held by spring force head-to-head, tightly against the inside tube by adjusting the width of the intermediate space.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
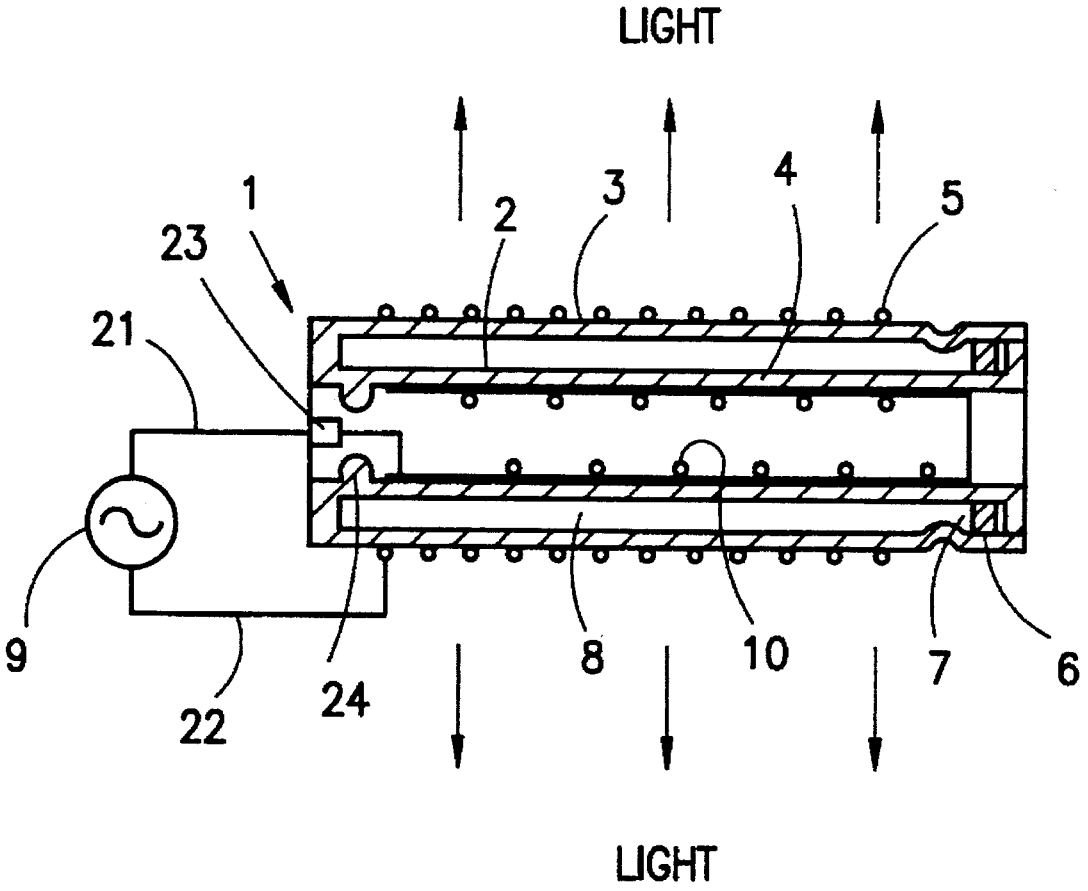
FIG. 1 is schematic depiction of a longitudinal cross section of a dielectric barrier discharge lamp according to the invention.

In the drawing, reference number 1 indicates a discharge vessel which has a double tube arrangement in which an inner tube 2 and an outer tube 3 formed of synthetic quartz glass are arranged coaxially to one another. Both ends of inner tube 2 and outer tube 3 are closed, and a discharge space 8 is formed therebetween.

Discharge vessel 1 has a total length of, for example, roughly 300 mm. Inner tube 2 has an outside diameter of 16 mm and a thickness of 1 mm, and outer tube 3 has an outside diameter of 24.5 mm and a thickness of 1 mm. In discharge space 8, xenon gas, for example, with a pressure of 40 kPa is encapsulated as a discharge gas.

Inner tube 2 is provided with an inner electrode 4 which functions as a light reflector disk, and also as the electrode of the dielectric barrier discharge. Outer tube 3 functions both as a dielectric of the dielectric barrier discharge and as a light exit window, and an outer electrode 5 is disposed on its outside surface. This outer electrode 5 is formed such that the metal wire is knitted seamlessly and cylindrically and has a lattice-like form, with which light can be emitted through the mesh. Discharge vessel 1 is inserted in the outer electrode.

One end of the discharge space 8 has an area 7 for receiving a getter 6 having barium as its main component. This getter 6 removes impurity gas (for example, water vapor) from within discharge space 8 and stabilizes the discharge.

Figure 2:
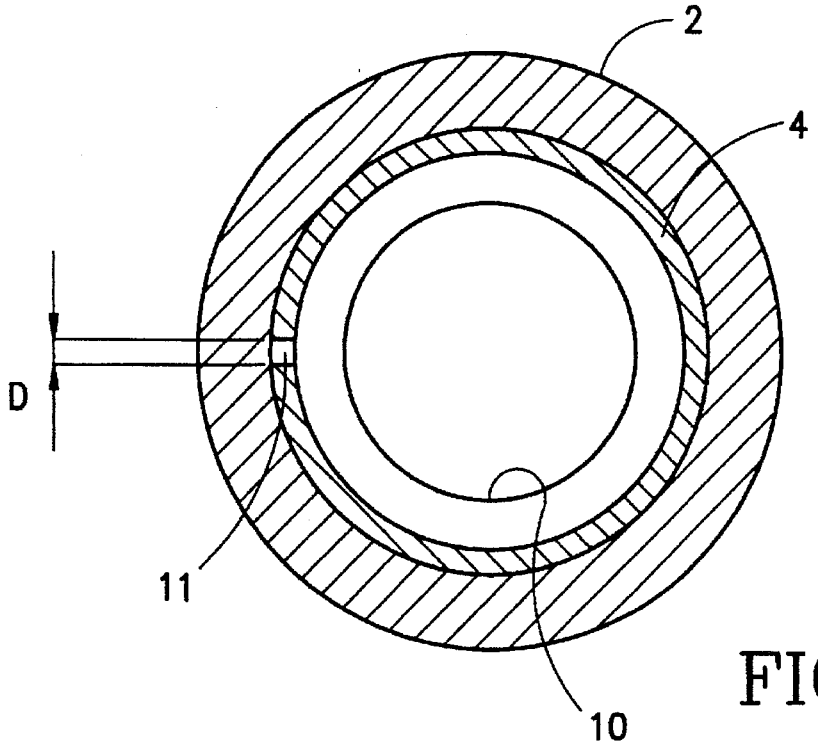
FIG. 2 shows a schematic transverse cross section of a first embodiment of an inside electrode of the dielectric barrier discharge lamp according to the invention.

FIG. 2 shows a cross sectional representation of inside tube 2 provided with inner electrode 4. The electrode 4 is made of a metallic tubular part that has a longitudinally extending gap 11. The inner electrode 4 can be easily produced even if the outside diameter is small. Furthermore, a good engagement of the electrode 4 on the inside surface of the inner tube 2 can be obtained, even if the inside diameter of the inner tube 2 varies slight in dimensions, and thus the delivery of power is effectively accomplished.

Inner electrode 4, in this embodiment, is produced, for example, such that aluminum foil with a thickness of 0.15 mm is bent. Distance D of the intermediate space of gap 11 is 0.9 mm.

Inner electrode 4 is held against the inside of the inner tube 2 by inserting a helical spring 10 within its ends. Furthermore, part of inner electrode 4 is elongated and is mechanically and electrically connected to a high voltage line 21.

By means of direct connection of the high voltage line 21 to inner electrode 4, a reliable dielectric barrier discharge lamp can be created and more simple manufacture achieved since inner electrode 4 is produced from only a single part.

Furthermore, it was found by the studies of the inventors that, as the result of a reduction in the occurrence of the dielectric barrier discharge, the discharge becomes nonuniform if peripheral distance D of gap 11 is greater than 3.0 mm. This means that a uniform discharge is obtained in the peripheral direction of the outer tube 3 if the maximum distance of gap 11 is set to be less than or equal to 3.0 mm.

Figure 3:
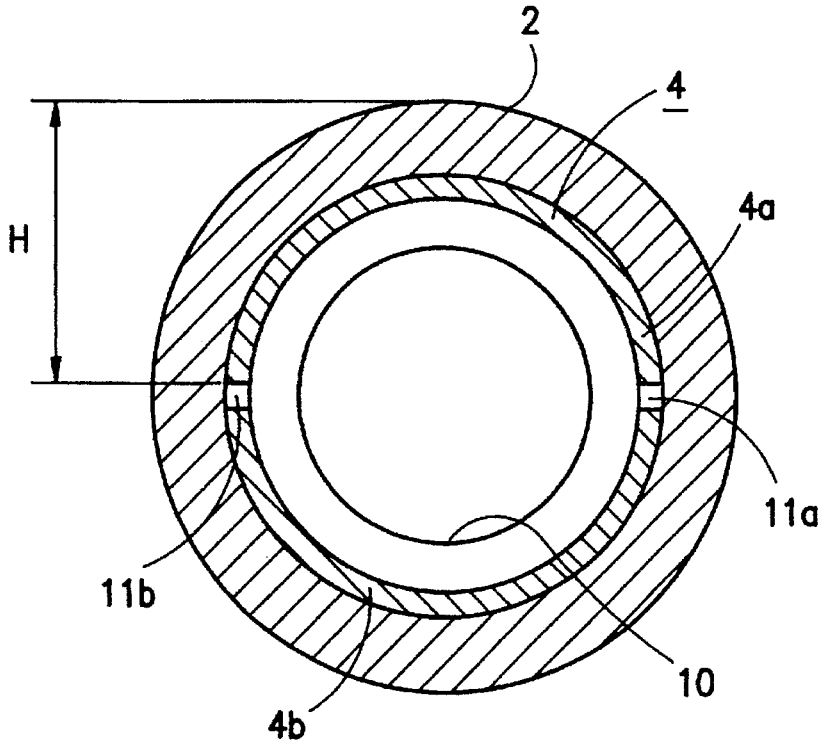
FIG. 3 shows a schematic transverse cross section of a second embodiment of the inside electrode of the dielectric barrier discharge lamp according to the invention.

FIG. 3 shows another embodiment of inner tube 2. On the inside of inner tube 2 there are two semicircular electrodes **4*a* and 4*b*, circumferentially separated by intermediate spaces 11*a* and 11*b*. These electrodes 4*a* and 4*b* are pressed against the inside surface of the inner tube 2 over the entire axial length thereof by means of helical spring 10**.

By inserting two semicircular electrodes **4*a* and 4*b* into inner tube 2 in this way, good contact can be obtained between electrode 4 and inner tube 2 by a simple process in which height H of semicircular electrode 4*a* or the curvature of semicircular parts 4*a* and 4*b* are set, even if the inside diameter of inner tube 2 varies to a minor degree. Therefore, an effective delivery of power to the discharge space can be accomplished, and furthermore, the electrodes can be more easily installed. The semicircular electrodes 4*a*, 4*b* are made of aluminum 0.5 mm thick, and intermediate spaces 11*a* and 11*b*** have circumferential lengths of 0.4 mm and 1.1 mm respectively.

Helical spring 10 is formed, for example, such that a wire of 0.5 mm stainless steel is turned helically with a distance of 13 mm. One end thereof is connected by means of a compression joining part 23 to high voltage line 21. Furthermore, on the end of the inner tube 2 by high voltage line 21, them is a projection 24 which extends radially toward the center of the inner tube 2. Outer electrode 5 is provided with a low voltage line 22 and is grounded as necessary.

By the arrangement of this helical spring 10 over the entire length of the inner electrode 4, firm contact between the inner electrode 4 and inner tube 2 can be maintained even if luminous operation continues over a long period. Furthermore, there are also cases in which, due to luminous operation over a long period, the above described inner electrode 4 is deformed and detaches from inner tube 2 because of its exposure within inner tube 2 during luminous operation to a temperature rise, for example, to roughly 300° C. The helical spring plays a major role in preventing this phenomenon.

Furthermore, by the measure in which one end of helical spring 10 and high voltage line 21 are connected to one another by means of compression joining part 23, a mechanically and electrically stronger connection is obtained in comparison to a connection which is based on frictional adhesion or the like.

Moreover, projection 24 can prevent inside electrode 4 from jumping out from inside electrode 4, even if an operator moves the above described lamp by inadvertently pulling it by the high voltage line 21, by the electrode catching on projection 24.

In this embodiment, when a 9.4 V voltage was applied to the lamp from power source 9, the load on the tube wall of the lamp was 0.25 W/cm$^2$, and vacuum ultraviolet light was emitted in a wavelength range from 160 nm to 80 nm with high efficiency; its peak being at a wavelength of 172 nm.

Figure 4:
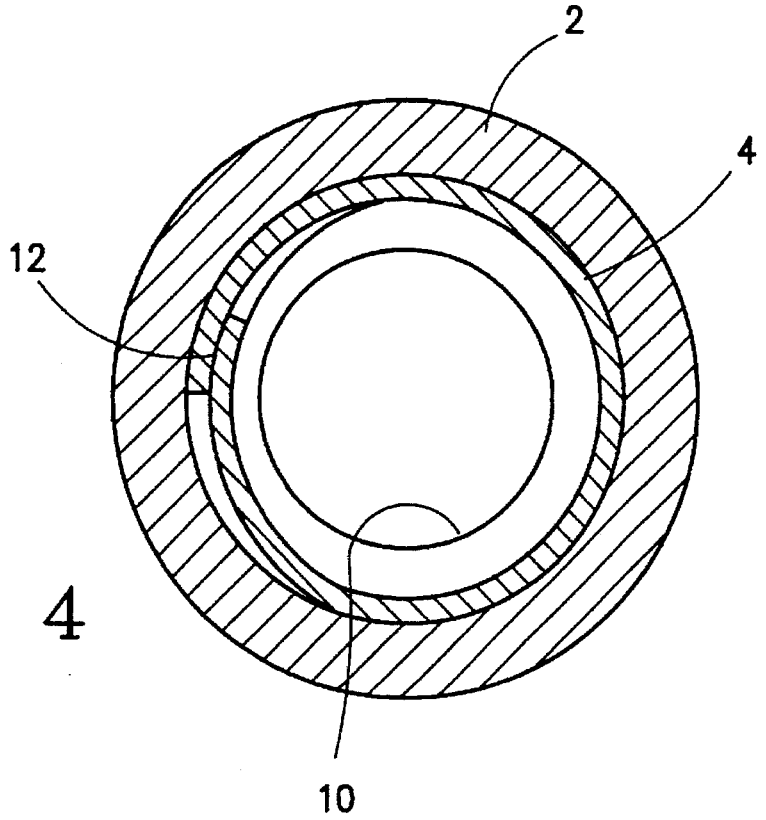
FIG. 4 shows a schematic transverse cross section of a third embodiment of the inside electrode of the dielectric barrier discharge lamp according to the invention.

FIG. 4 shows another embodiment of the inner electrode 4. Inner electrode 4 is formed, for example, such that an elastic metal sheet, such as aluminum or the like, is bent into a tubular arrangement in which longitudinally extending edge portions rest one on top of the other as is shown in the drawing.

By means of this extremely Simple arrangement inner electrode 4 can be arranged tightly against the inside of the inner tube 2, and furthermore, the manufacture thereof can be easily achieved.

In addition, by means of an extremely simple process in which the width of overlapping part 12 of inside electrode 4 is set, good surface engagement between the inner electrode 4 and the inner tube 2 is achieved, even if the inside diameter of inner tube 2 has varies to a minor degree.

In this embodiment, inside electrode 4 is, for example, 0.08 mm thick. It is, however, desirable that this thickness be in the range from 0.03 mm to 0.1 mm. The reason for this is that at a thickness of greater than or equal to 0.03 mm conductivity can be adequately ensured in functioning as a discharge electrode, even if the surface is corroded by ozone, and that at a thickness of less than or equal to 0.1 mm the width of overlapping part 12 can be easily adjusted.

Figure 5:
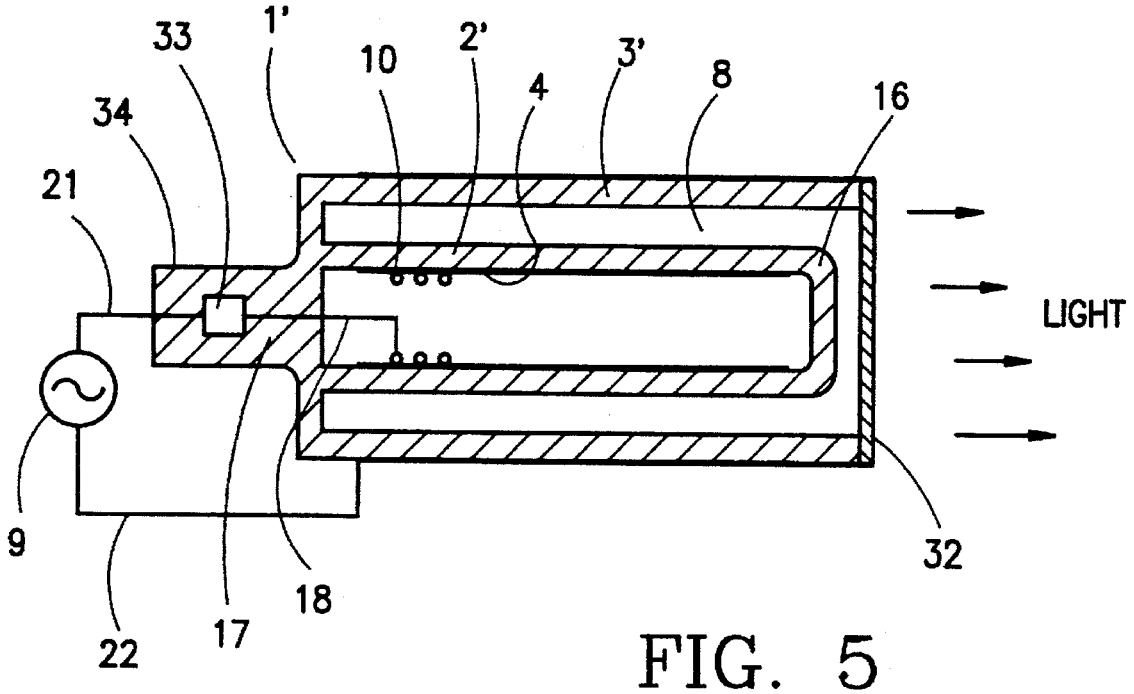
FIG. 5 is a schematic depiction of another dielectric barrier discharge lamp according to the invention.

FIG. 5 illustrates another embodiment of the dielectric barrier discharge lamp according to the invention. One end of outer tube 3' is provided with a synthetic quartz glass light exit window 32 from which the light can emerge in the manner of beams and which forms one end of the discharge vessel 1'. In this case, the inner tube 2' has a hermetically sealed arrangement at both end 16 and end 17.

Hermetically sealed inner tube 2' was produced such that inner electrode 4 was inserted into the inside of inner tube 2' (which is originally open at end 17), then the inside of inner tube 2' was evacuated and nitrogen gas with introduced to a pressure of 60 kPa, after which inner tube 2' was hermetically sealed at end 34. The electrical input into inner electrode 4 is produced by connecting molybdenum wire 18 to helical spring 10 at one end of inside electrode 4, this wire being connected to power source 9 via molybdenum foil 33 and high voltage line 21.

Inner electrode 4 can also have an arrangement in which it is longitudinally split as is shown in FIG. 2 or it can be formed of two substantially semi-cylindrical parts as is shown in FIG. 3. Moreover, a design can be used in which there is partial overlapping at longitudinal edges, as is shown in FIG. 4. Furthermore, in this embodiment the excimer light emitted from the excimer molecules is emitted from axially via the light exit window 32 instead of radially as with the FIG. 1 arrangement.

In the dielectric barrier discharge lamp with the above described arrangement, inner electrode 4 can be located within a hermetically sealed space, and thus, ozone formation can be prevented by encapsulation of an inert gas, such as nitrogen or the like, in this space. Therefore, corrosion of the inner electrode can be prevented and a dielectric barrier discharge lamp with a long service life can be obtained.

In addition, air can be prevented from penetrating into the gap which forms between the inner electrode 4 and the inner tube 2. Therefore, oxygen in this air can be prevented from absorbing the excimer light and reducing its light intensity.

Moreover, a host of advantages arise by using aluminum as the inner electrode material and by its thickness being 0.1 mm to 1.0 mm:

First of all, light output with high efficiency can be obtained since the vacuum ultraviolet light formed by the dielectric barrier discharge is effectively reflected from the aluminum inside electrode.

Second, the inner tube is not damaged when the aluminum inside electrode is inserted into the inner tube made of a quartz glass tube because the aluminum is soft.

Third, by the aluminum having a thickness of greater than or equal to 0.1 mm, in spite of its actual low mechanical strength, easy insertion into the inner tube can be achieved.

Fourth, by the thickness of the aluminum being less than or equal to 1.0 mm, free shaping according to the contour of the inner tube can be accomplished.

Furthermore, it is desirable that the inner electrode 4 which comes into contact with the inner tube be a metal part the surface of which has a reflectance factor of no more than 30% at a wavelength of 172 nm.

The reason for this is the following:

In the dielectric barrier discharge lamp according to the invention, xenon is used as the discharge gas. In doing so, vacuum ultraviolet light is emitted which is the excimer light of this xenon and which has its peak at a wavelength of 172 nm and a width of roughly 14 nm. There is the danger that some of this vacuum ultraviolet light will be absorbed by the quartz glass which forms the discharge vessel, causing a fault in the quartz glass. The occurrence of distortion by this vacuum ultraviolet light is greater, the greater the amount of irradiation of the vacuum ultraviolet light and the higher the temperature of the quartz glass. Furthermore, the distortion occurs more frequently since the temperature of the inner tube is higher than the temperature of the outside tube, by which the inner tube is easily destroyed.

By means of the measure in which a metal part is used in which the reflectance factor of the light with wavelength of 172 nm is less than or equal to 30%, the amount of vacuum ultraviolet light can be reduced which is reflected by the inner electrode and is incident in the inner tube, and thus, the occurrence of distortion can likewise be suppressed.

According to the invention, for purposes of delivering power to the dielectric barrier discharge lamp, by a welding process, a pressure joining process, a screw attachment or the like, the power line 21 can be mechanically and at the same time electrically connected to the helical spring. In this case, power can be supplied extremely reliably by a simple arrangement.

According to the invention, for purposes of delivering power to the dielectric barrier discharge lamp, by a welding process, a pressure joining process, a screw attachment or the like the line can be mechanically and at the same time electrically connected directly to the inside electrode. In this case extremely reliable power can also be supplied by a simple arrangement.

In the invention, by means of a measure in which, for purposes of delivering power to the dielectric barrier discharge lamp, the line is routed out from one end of the inner tube, and in which on the end of the inner tube from which the line is routed out, on the side of tube 2 facing away from the discharge space, there is a projection, the inner electrode 4 is prevented from catching on the projection and the inside electrode is prevented from jumping out, even if the operator moves the above described dielectric barrier discharge lamp by unintentionally pulling it by the power line 21.

It is to be understood that although preferred embodiments of the invention has been described, various other embodiments and variations may occur to those skilled in the art. Any such other embodiments and variations which fall within the scope and spirit of the present invention are intended to be covered by the following claims.

What we claim is:

1. Dielectric barrier discharge lamp having a generally cylindrical double-tube arrangement of an outer tube coaxially disposed about an inner tube, an outer electrode being disposed on an outside surface of the outer tube, an inner electrode being disposed on an inside surface of the inner tube, and a discharge space being provided between the outer tube and the inner tube which is filled with a discharge gas for formation of excimer molecules by dielectric barrier discharge; wherein said inner electrode is a generally tubular part which includes a slit in an axial direction along the full length thereof.

2. Dielectric barrier discharge lamp according to claim 1, wherein said inner electrode has a gap between longitudinally extending edges thereof that is less than or equal to 3.0 mm in a circumferential direction.

3. Dielectric barrier discharge lamp according to claim 2, wherein the inner electrode comprises two semi-cylindrical parts with a said gap at each of opposite sides thereof.

4. Dielectric barrier discharge lamp according to claim 2, wherein the inner electrode is held in firm contact with the inner surface of the inner tube by a helically coiled spring.

5. Dielectric barrier discharge lamp according to claim 4, wherein the inner electrode is connected to a power line via said spring.

6. Dielectric barrier discharge lamp according to claim 1 wherein the generally tubular part of which said inner electrode is formed is a metal sheet bent into a tubular shape having opposite longitudinally extending edge portions lying one on top of the other.

7. Dielectric barrier discharge lamp according to claim 6, wherein the thickness of the metal sheet which forms said inner electrode is in a range from 0.03 mm to 0.1 mm.

8. Dielectric barrier discharge lamp according to claim 6, wherein the inner electrode is held in firm contact with the inner surface of the inner tube by a helically coiled spring.

9. Dielectric barrier discharge lamp according to claim 8, wherein the inner electrode is connected to a power line via said spring.

10. Dielectric barrier discharge lamp according to claim 1, wherein said inner electrode is made of aluminum having a thickness in a range of from 0.1 mm 1.0 mm.

11. Dielectric barrier discharge lamp according to claim 10, wherein the inner electrode is held in firm contact with the inner surface of the inner tube by a helically coiled spring.

12. Dielectric barrier discharge lamp according to claim 11, wherein the inner electrode is connected to a power line via said spring.

* * * * *